US006255649B1

(12) United States Patent
Claflin, Jr. et al.

(10) Patent No.: US 6,255,649 B1
(45) Date of Patent: Jul. 3, 2001

(54) CHARGING DEVICE WITH GRID TENSIONING SHAFTS

(75) Inventors: Alfred J. Claflin, Jr., Ontario; Andrew J. Bonacci, Rochester; David A. D'Angelantonio, Webster; Jaime Soley, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/364,299

(22) Filed: Jul. 29, 1999

(51) Int. Cl.[7] ..... H01T 19/04
(52) U.S. Cl. ..... 250/325; 250/324
(58) Field of Search ..... 250/325, 326, 250/324; 399/173, 168, 170; 361/225

(56) References Cited

U.S. PATENT DOCUMENTS 4,603,964 * 8/1986 Swistak ..... 250/325

* cited by examiner

*Primary Examiner*—Kiet T. Nguyen

(57) ABSTRACT

A charging device comprises a housing defining a charging chamber. Two tensioning shafts are mounted on opposite ends of the housing. The charging device comprises a control grid attached to the grid tensioning shafts, thus substantially covering the chamber opening. The control grid is comprised of a conductive material capable of being stretched along its length. As a result, the grid becomes flat when opposing rotating forces are applied to the two tensioning shafts.

20 Claims, 5 Drawing Sheets

CHARGING DEVICE WITH GRID TENSIONING SHAFTS

FIELD OF THE DISCLOSURE

This disclosure relates generally to charging devices used in electrophotographic printing and, in particular, to a charging device with grid tensioning shafts.

BACKGROUND OF THE INVENTION

It is known to use charging devices to charge a photosensitive member in electrophotographic printing. See, generally, R. M. Schaffert, The Focal Press, New York, 1965.

As is known, some charging devices include a control grid to regulate and control the charge provided to the photosensitive member, resulting in the photosensitive member receiving a uniform charge. Such charging devices with control grids are typically of the following types: scorotron, discorotron, and pin scorotron. Some benefits and problems associated with such control grids are discussed in Lewis E. Walkup, U.S. Pat. No. 2,777,957, especially FIGS. 4–7 and the text corresponding thereto. See also Geoffrey M. T. Foley, U.S. Pat. No. 4,638,397, especially columns 1–2.

To achieve uniform charging results, the control grid or screen must be parallel to the photosensitive member. A related requirement is that the control grid itself must be as flat as possible. This latter problem of control grid flatness is discussed in Joseph H. Lang et al., U.S. Pat. No. 4,792,680, especially columns 3–4.

The problem, therefore, is how to achieve a charging device with a flat control grid.

One existing method for achieving grid flatness is to form a grid from a stamped or etched hexagonal sheet stock, the grid being formed into a channel with side shields. While this method achieves a grid flatness of 0.25 to 0.50 mm, this method is not acceptable where a greater degree of flatness is required.

Another existing method for achieving grid flatness is to apply tension to the grid by means of springs and pulling tension at a singular point of grid attachment. This method, however, usually results in the unwanted curling or cupping of the grid. Moreover, this method is typically not useful where extrapolation to wide charge devices is required.

Therefore, there is a need for an improved charging device with a flat control grid.

SUMMARY OF THE INVENTION

In one aspect of the invention, a charging device comprises a housing. The housing comprises a housing inboard end and a housing outboard end. An inboard tensioning shaft is mounted on the housing inboard end, and an outboard tensioning shaft mounted on the housing outboard end. The charging device comprises a grid with a plurality of grid openings embedded therein. The grid comprises a grid inboard end and a grid outboard end with a length extending therebetween, and a grid upstream edge and a grid downstream edge with a width extending therebetween. The grid inboard end is attached to the inboard tensioning shaft and the grid outboard end attached to the outboard tensioning shaft. The grid comprises a material capable of being stretched along the length and becoming flat when opposing rotating forces are applied to the inboard and outboard tensioning shafts.

DESCRIPTION OF THE PREFERRED EMBODIMENTS

Figure 1:
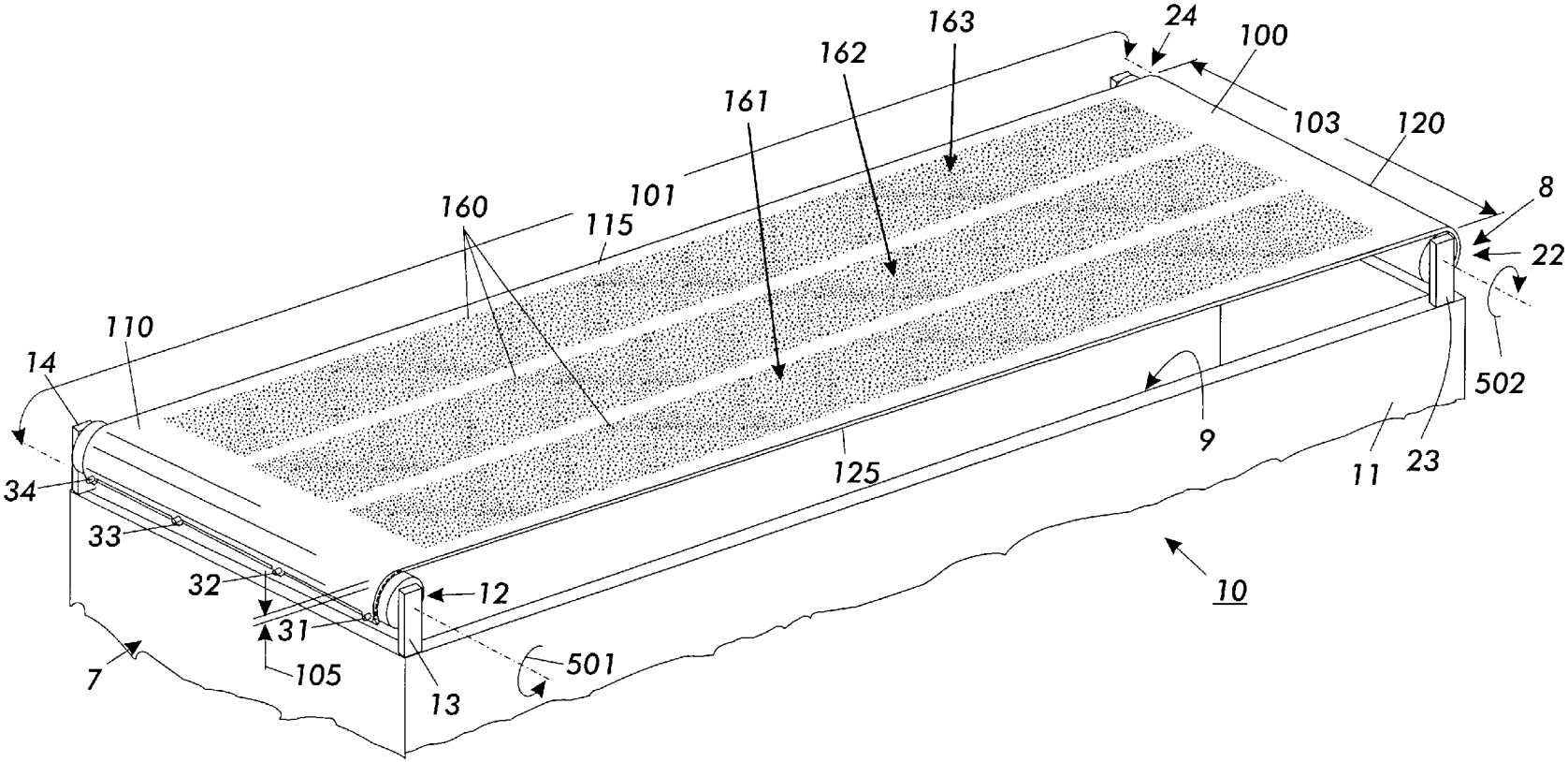
FIG. 1 is a perspective view of a charging device with grid tensioning shafts, in accordance with the present invention.

Referring now to FIG. 1, there is shown a charging device 10 comprising a housing 11. As shown, the housing comprises a housing inboard end 7 and a housing outboard end 8.

The housing 11 defines a concave charging chamber 9. The charging chamber 9 has mounted therein a charge-generating device (not shown) comprising a bare wire, dielectric-coated wire, or pin array.

The charging device 10 comprises a conductive control grid 100 substantially covering the opening of the charging chamber 9. The control grid 100 is generally rectangular in shape and comprised of a material having a thickness 105 with a plurality of grid openings 160 embedded therein. The grid 100 comprises a grid inboard end 110 and a grid outboard end 120, with a length 101 (this length being more fully depicted in FIG. 2) extending between the grid inboard end 110 and the grid outboard end 120. Also, the grid 100 comprises a grid upstream edge 115 and a grid downstream edge 125, with a width 103 extending between the grid upstream edge 115 and the grid downstream edge 125. It will be understood that the upstream edge 115 and downstream edges 125 respectively correspond to the upstream and downstream directions of the electrophotographic printing process.

As will be more fully described below, the grid inboard end 110 is attached to an inboard tensioning shaft or mandrel 12 which, in turn, is mounted on the housing inboard end 7 by means of a first fastening post 13 and a second fastening post 14. As well, the grid outboard end 120 is attached to an outboard tensioning shaft or mandrel 22 which, in turn, is mounted on the housing outboard end 8 by means of a third fastening post 23 and a fourth fastening post 24. (The fastening post 24 is indicated but not visible in FIG. 1).

The control grid 100 is comprised of a conductive material capable of being stretched along the length 101 and becoming flat when opposing rotating forces are applied to the inboard tensioning shaft 12 and the outboard tensioning shaft 22. These opposing rotating forces are depicted as a counter-clockwise torque force 501 applied to the inboard tensioning shaft 12 and a clockwise torque force 502 applied to the outboard tensioning shaft 22.

In one embodiment, the charge-generating device (not shown) comprises a bare wire and charging device 10 is a scorotron. In another embodiment, the charge-generating device comprises a dielectric-coated wire and charging device 10 is a discorotron. In still another embodiment, the charging device comprises a pin array and charging device 10 is a pin scorotron.

Figure 2:
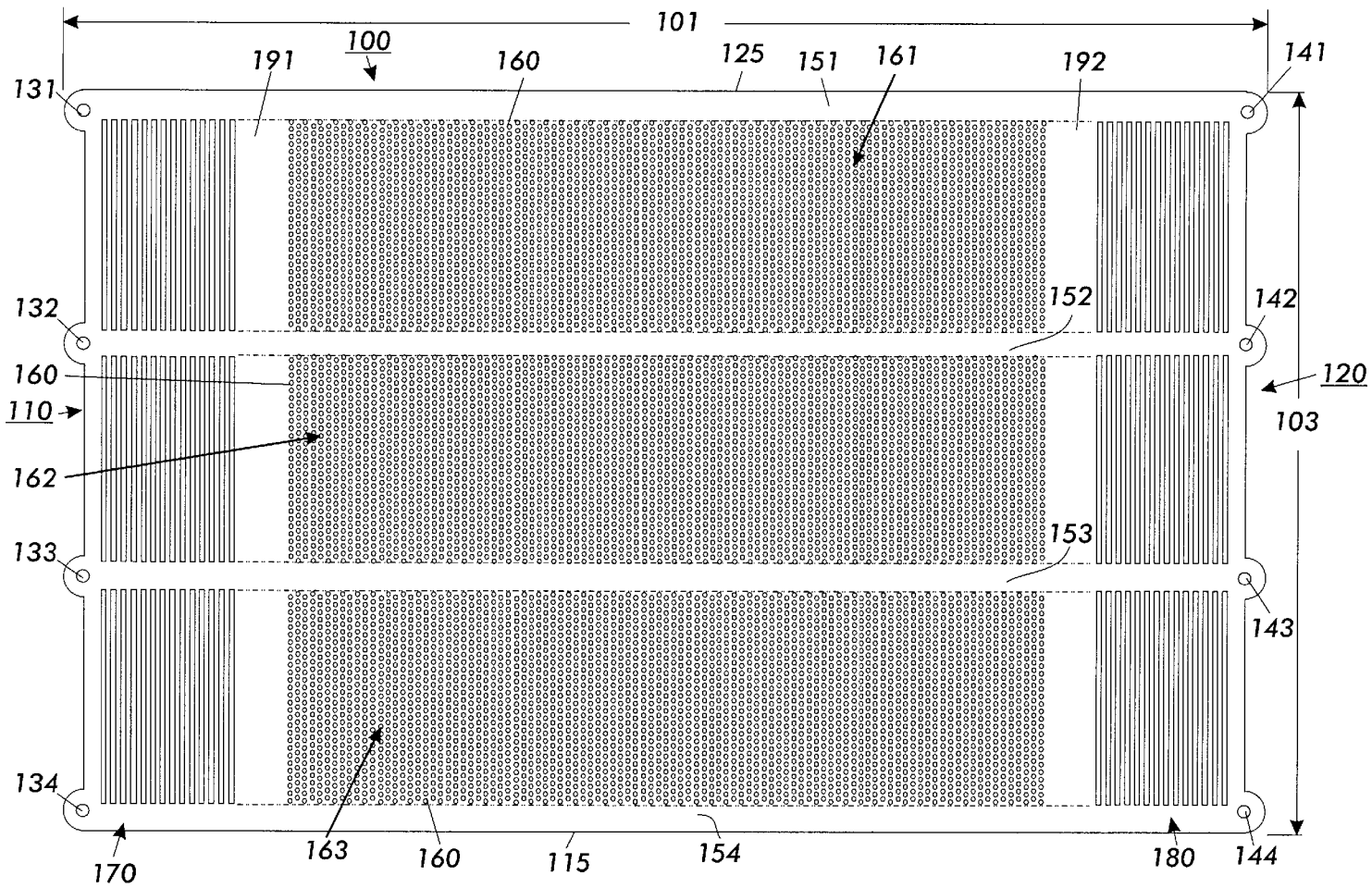
FIG. 2 is a bottom view of a control grid of the FIG. 1 charging device.

FIG. 2 shows a bottom top view of the grid 100. This view corresponds to grid 100 as would be seen from the position of the charge-generating device within the charging chamber 9. As shown, the grid 100 comprises a plurality of four (4) solid parallel bands 151–154 devoid of the grid openings 160. The bands 151–154 extend along the length 101 between the grid inboard end 110 and the grid outboard end 120. The four bands 151–154, in turn, define three (3) rectangular regions 161–163 comprising the grid openings 160. In one embodiment, the plurality of grid openings 160 form a mesh pattern in the regions 161–163.

The band 151 comprises a first band opening 131 near the grid inboard end 110 and a second band opening 141 near the grid outboard end 120. Likewise, the solid band 152 comprises a first band opening 132 near the grid inboard end 110 and a second band opening 142 near the grid outboard end 120. As well, the solid band 153 comprises a first band opening 133 near the grid inboard end 110 and a second band opening 143 near the grid outboard end 120. Finally, the solid band 154 comprises a first band opening 134 near the grid inboard end 110 and a second band opening 144 near the grid outboard end 120. Thus, the plurality of bands 151–154 form a plurality of first band openings (hereinafter the "inboard band openings") 131–134 near the grid inboard end 110 and a plurality of second band openings (hereinafter the "outboard band openings") 141–144 near the grid outboard end 120.

As shown, a first band 154 forms the grid upstream edge 115. A second band 151 forms the grid downstream edge 125. A third band 152 and a fourth band 153 are disposed within the grid 100 so that the spacing between adjacent bands is about equal. Thus, the separations between bands 151–152, bands 152–153, and bands 153–154 are approximately equal.

The grid 100 comprises a first pattern of ribs (hereinafter the "inboard rib pattern") 170 embedded therein adjacent and parallel to the grid inboard end 110. Likewise, the grid 100 comprises a second pattern of ribs (hereinafter the "outboard rib pattern") 180 embedded therein adjacent and parallel to the grid outboard end 120. The inboard rib pattern 170 and the outboard rib pattern 180 extend substantially across the width 103.

The grid 100 comprises a first solid area (hereinafter the "inboard solid area") 191 disposed adjacent and parallel to the inboard rib pattern 170. Likewise, the grid 100 comprises a second solid area (hereinafter the "outboard solid area") 192 disposed adjacent and parallel to the outboard rib pattern 180. The inboard solid area 191 and the outboard solid area 192 are devoid of grid openings 160.

Figure 3:
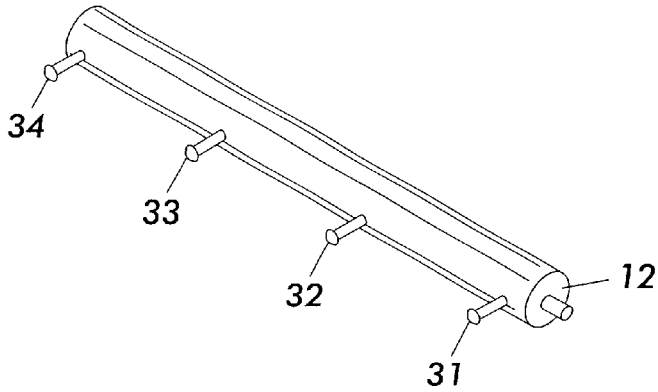
FIG. 3 is a perspective view of a first grid tensioning shaft of the FIG. 1 charging device.
Figure 4:
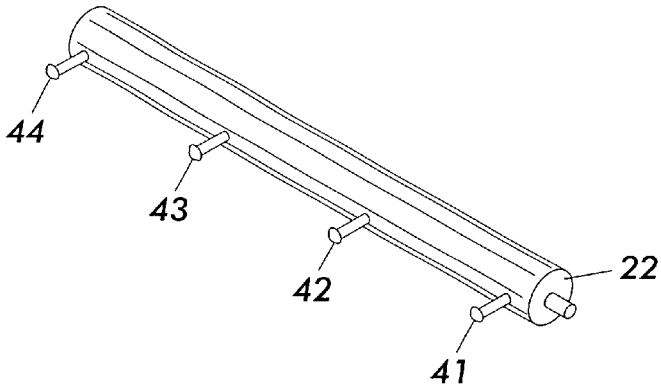
FIG. 4 is a perspective view of a second grid tensioning shaft of the FIG. 1 charging device.

Referring now to FIGS. 3–4, there are perspective views respectively of the inboard grid tensioning shaft 12 and the outboard grid tensioning shaft 22. The inboard tensioning shaft 12 comprises a plurality of inboard fastening pins or teeth 31, 32, 33 and 34 protruding therefrom and arranged for respectively engaging the plurality of inboard band openings 131, 132, 133 and 134. Similar to the inboard tensioning shaft 12, the outboard tensioning shaft 22 comprises a plurality of inboard fastening pins or teeth 41, 42, 43 and 44 protruding therefrom and arranged for respectively engaging the plurality of out board band openings 141, 142, 143 and 144.

Figure 5:
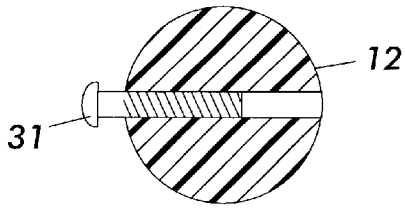
FIG. 5 is a side view of the FIG. 3 grid tensioning shaft.

Referring now to FIG. 5, there is a side view of the inboard tensioning shaft 12, depicting the inboard fastening pin or tooth 31 protruding therefrom.

Referring back to FIG. 1, inboard fastening pins 31–34 are depicted extending through and thus engaging the inboard band openings 131–134. While not depicted, it likewise will be appreciated that outboard fastening pins 41–44 extend through and thus engage the outboard band openings 141–144.

Figure 6:
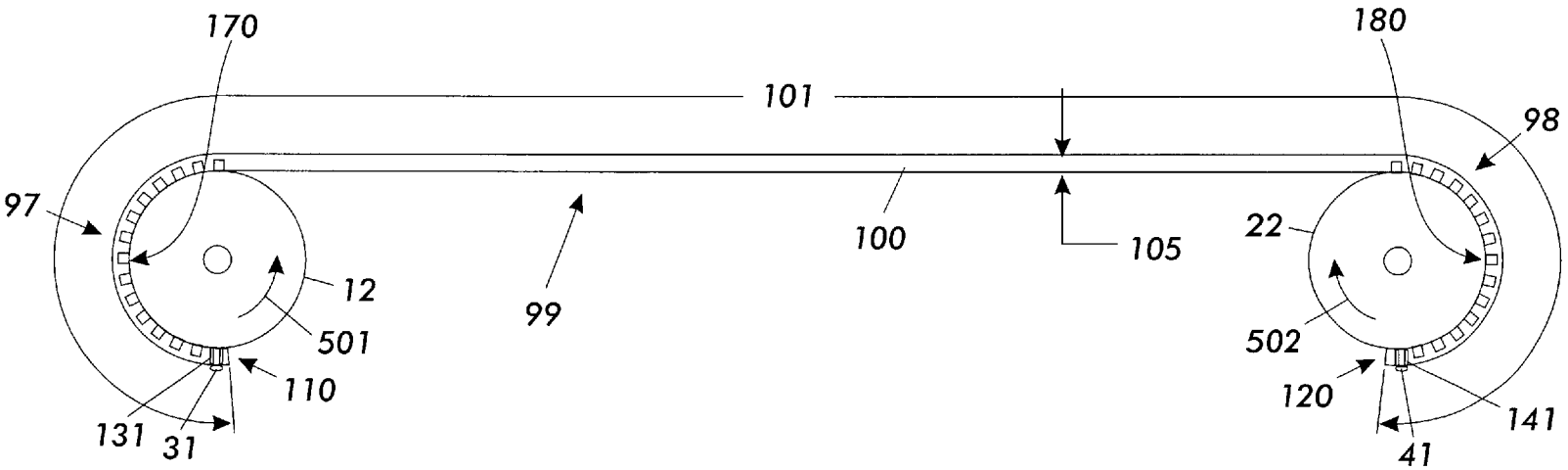
FIG. 6 is a side view of the grid and two tensioning shafts of FIG. 1.

Referring now to FIG. 6, there is a side view of the grid 100 mounted on and attached to the inboard tensioning shaft 12 and the outboard tensioning shaft 22. As shown, the inboard rib pattern 170 and the outboard rib pattern 180 respectively face the inboard tensioning shaft 12 and the outboard tensioning shaft 22. The inboard and outboard rib patterns 170 and 180 are embedded in the grid 100, extending from the grid surface 99 to a depth of about one-half the grid thickness 105.

As depicted in FIG. 6, the inboard tensioning shaft 12 attaches to the grid 100 inboard end 110 by means of the tensioning shaft 12 fastening pin 31 that extends through and engages the grid 100 inboard band opening 131. While only inboard fastening pin 31 and inboard band opening 131 are depicted, it will be appreciated that the remaining inboard fastening pins 32–34 likewise extend through and engage inboard band openings 132–134, respectively, thus further attaching the inboard tensioning shaft 12 to the grid inboard end 110.

Likewise, as depicted in FIG. 6, the outboard tensioning shaft 22 attaches to the grid 100 outboard end 120 by means of the tensioning shaft 22 fastening pin 41 that extends through and engages the grid 100 outboard band opening 141. While only outboard fastening pin 41 and outboard band opening 141 are depicted, it will be appreciated that the remaining outboard fastening pins 42–44 likewise extend through and engage outboard band openings 142–144, respectively, thus further attaching the outboard tensioning shaft 22 to the grid outboard end 120.

As depicted in FIG. 6, ribs of the inboard rib pattern 170 are adjacent to and contact the surface of the inboard tensioning shaft 12. Likewise, ribs of the outboard rib pattern 180 are adjacent to and contact the surface of the outboard tensioning shaft 22. When the counter-clockwise rotating force 501 is applied to the inboard tensioning shaft 12 and the clockwise rotating force 502 is applied to the outboard tensioning shaft 22, a first portion 97 of inboard rib pattern 170 wraps securely around the surface of the inboard tensioning shaft 12 and a second portion 98 of outboard rib pattern 180 wraps securely around the surface of the outboard tensioning shaft 22. Moreover, the opposing rotating forces 501 and 502 cause the grid 100 to be stretched along its length 101 so that the grid 100 becomes flat.

In practice, the opposing torque forces 501 and 502 cause the tensioning shafts 12 and 22 respectively to rotate in opposite directions. As a result of this opposing rotation by the tensioning shafts 12 and 22, the grid 100 is stretched and flattened along the length 101. The opposing torque forces 501 and 502 and rotation by shafts 12 and 22 continue until the grid 100 is stretched sufficiently flat. At this point, the grid tension and corresponding grid flatness is maintained by locking the shafts 12 and 22 in place by any convenient means, thereby preventing any reverse shaft rotation which would tend to lessen or release the grid tension. In one embodiment, for example, the fastening posts 13–14 and 23–24 are equipped with locking devices which apply friction to the tensioning shafts 12 and 14, thus preventing any subsequent reverse rotation.

The inboard and outboard rib patterns 170 and 180 act to minimize chordal effects such that the grid 100 wraps with intimate contact to the respective inboard and outboard tensioning shafts 12 and 22. Moreover, the tensioning shafts 12 and 22 are essentially straight, thus resulting in a very flat grid profile across the grid width 103, corresponding to the electrophotographic printing process direction.

In one embodiment, the grid length 101 is about 495 mm, and the width 103 is about 77 mm. Also in this embodiment:

The plurality of grid openings 160 comprise a hex pattern with a cumulative open area that is about 85% of the total area of the mesh pattern in the regions 161–163. The inboard and outboard rib patterns 170 and 180 comprise thirteen (13) ribs each pattern, each rib about 10 mils wide, with ribs disposed on 20 mil centers. The inboard and outboard solid areas 191 and 192 are about 40 mm wide each area. The conductive material comprises stainless steel with a thickness 105 of about 4 mils. Each of the two tensioning shafts or wrap mandrels 12 and 22 are about 6 mm in diameter. Finally, each of the solid parallel bands 151–154 is about 1 mm wide.

Figure 7:
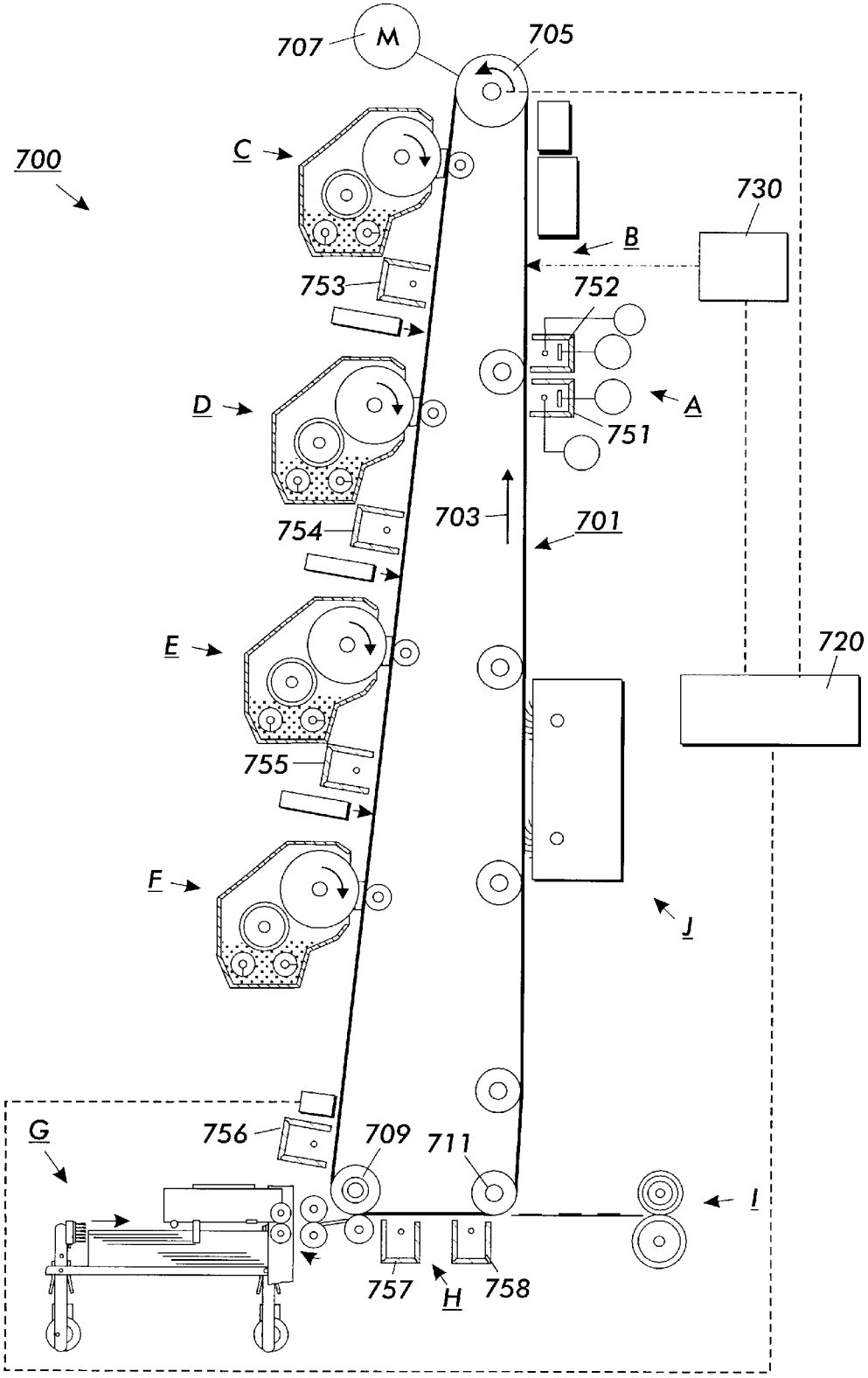
FIG. 7 shows a printing machine having the FIG. 1 charging device therein.

It will be appreciated that a printing machine may be arranged with a charging device with grid tensioning shafts, in accordance with the present invention. Referring now to FIG. 7, for example, there is shown an exemplary printing machine 700 arranged with a charging device in accordance with the present invention.

As shown in FIG. 7, the printing machine 700 uses a photoreceptor belt 701 supported for movement in the direction indicated by arrow 703 for advancing sequentially through various xerographic process stations designated A–J. The belt is entrained about a drive roller 705, tension roller 709 and fixed roller 711. The roller 705 is operatively connected to a drive motor 707 for effecting movement of the belt through the stations A–J.

Still referring to FIG. 7, a portion of belt 701 passes through charging station A where a corona generating device comprising first and second charging devices 751 and 752 charges the photoconductive surface of belt 701 to a relatively high, substantially uniform, negative potential.

Next, the charged portion of photoconductive surface is advanced through an imaging/exposure station B. At imaging/exposure station B, a scanning device 730 causes the charge retentive surface 701 to be discharged based on image signals received from controller 720 representing the desired output image. Preferably the scanning device 730 is a laser Raster Output Scanner (ROS). Alternatively, the scanning device 730 may comprise other xerographic exposure devices, such as LED arrays.

The photoreceptor 701 then moves in sequence to the four (4) development stations respectively designated C–F where, at each respective station, a first, second, third, and fourth toner is applied to the photoreceptor surface 701 based on the particular image or exposure that was charged on the photoreceptor surface 701 by the scanning device 730. Note that the three (3) development stations C–E each respectively include third, fourth and fifth charging devices designated 753–755.

Subsequent to image development, a sheet feeding station G advances a sheet of substrate such as, for example, paper, to transfer station H. Note that sheet feeding station G comprises a sixth charging device designated 756.

Next, the sheet of substrate is moved into contact with the toner images at transfer station H. Note that transfer station H comprises a seventh (transfer) charging device 757 which sprays positive ions onto the backside of the substrate sheet, these positive ions attracting the negatively-charged toner powder images from the belt 701 to the substrate sheet. An eighth (detack) charging device 758 facilitates stripping of the sheets from the belt 701.

After transfer, the substrate sheet separates from the belt 701 and advances to fusing station 1, which permanently affixes the transferred powder image to the substrate sheet.

At the final station J, the residual toner particles carried by the non-image areas on the photoconductive surface 701 are removed using a cleaning brush or plural brush structure.

Still referring to FIG. 7, it will be appreciated that any or all of the eight (8) charging devices designated 751–758 may comprise a charging device with grid tensioning shafts, in accordance with the present invention.

As a result of the present invention, a grid flatness of less than 0.040 mm is achieved. This grid flatness represents approximately an order of magnitude improvement over existing grids having a flatness of about 0.25 to 0.50 mm. Moreover, the present invention results in uniform elongation (strain) of the 4 symmetrically-spaced solid continuous bands 151–154, thereby eliminating non-uniform stresses, especially at the outer edges and non-axial coupling across the grid width 103.

While various embodiments of a charging device with grid tensioning shafts, in accordance with the preferred embodiment have been described above, the scope of the invention is defined by the following claims.

What is claimed is:

1. A charging device comprising a housing, the housing comprising a housing inboard end and a housing outboard end, an inboard tensioning shaft mounted on the housing inboard end, an outboard tensioning shaft mounted on the housing outboard end, the charging device comprising a grid, the grid comprising a plurality of grid openings embedded therein, the grid comprising a grid inboard end and a grid outboard end with a length extending therebetween, a grid upstream edge and a grid downstream edge with a width extending therebetween, the grid inboard end attached to the inboard tensioning shaft, the grid outboard end attached to the outboard tensioning shaft, the grid comprising a material capable of being stretched along the length and becoming flat when opposing rotating forces are applied to the inboard and outboard tensioning shafts.

2. The charging device of claim 1, the grid comprising a plurality of bands devoid of grid openings extending between the grid inboard and outboard ends, each band comprising a first band opening near the grid inboard end thus forming a plurality of inboard band openings, and a second band opening near the grid outboard end thus forming a plurality of outboard band openings.

3. The charging device of claim 2, the inboard tensioning shaft comprising a plurality of inboard fastening pins for engaging the plurality of inboard band openings, the outboard tensioning shaft comprising a plurality of outboard fastening pins for engaging the plurality of outboard band openings.

4. The charging device of claim 3, the plurality of grid openings forming a mesh pattern in regions between adjacent bands.

5. The charging device of claim 3, a first band of the plurality of bands forming the grid upstream edge, a second band of the plurality of bands forming the grid downstream edge.

6. The charging device of claim 5, a third band and a fourth band of the plurality of bands disposed within the grid so the spacing between adjacent bands is about equal.

7. The charging device of claim 3, the grid comprising an inboard rib pattern adjacent to the grid inboard end and an outboard rib pattern adjacent to the grid outboard end, the inboard and outboard rib patterns extending across the width and embedded in the grid so the inboard and outboard rib patterns wrap around respectively the inboard and outboard tensioning shafts when opposing rotating forces are applied to the inboard and outboard tensioning shafts.

8. The charging device of claim 7, the grid comprising a first solid area adjacent to the inboard rib pattern and a second solid area adjacent to the outboard rib pattern, the first and second solid areas devoid of grid openings.

9. The charging device of claim 7, the inboard rib pattern comprising thirteen ribs and the outboard rib pattern comprising thirteen ribs.

10. The charging device of claim 7, the plurality of grid openings comprising a hex pattern.

11. A printing machine comprising a charging device, the charging device comprising a housing, the housing comprising a housing inboard end and a housing outboard end, an inboard tensioning shaft mounted on the housing inboard end, an outboard tensioning shaft mounted on the housing outboard end, the charging device comprising a grid, the grid comprising a plurality of grid openings embedded therein, the grid comprising a grid inboard end and a grid outboard end with a length extending therebetween, a grid upstream edge and a grid downstream edge with a width extending therebetween, the grid inboard end attached to the inboard tensioning shaft, the grid outboard end attached to the outboard tensioning shaft, the grid comprising a material capable of being stretched along the length and becoming flat when opposing rotating forces are applied to the inboard and outboard tensioning shafts.

12. The printing machine of claim 11, the grid comprising a plurality of bands devoid of grid openings extending between the grid inboard and outboard ends, each band comprising a first band opening near the grid inboard end thus forming a plurality of inboard band openings, and a second band opening near the grid outboard end thus forming a plurality of outboard band openings.

13. The printing machine of claim 12, the inboard tensioning shaft comprising a plurality of inboard fastening pins for engaging the plurality of inboard band openings, the outboard tensioning shaft comprising a plurality of outboard fastening pins for engaging the plurality of outboard band openings.

14. The printing machine of claim 13, the plurality of grid openings forming a mesh pattern in regions between adjacent bands.

15. The printing machine of claim 13, a first band of the plurality of bands forming the grid upstream edge, a second band of the plurality of bands forming the grid downstream edge.

16. The printing machine of claim 15, a third band and a fourth band of the plurality of bands disposed within the grid so the spacing between adjacent bands is about equal.

17. The printing machine of claim 13, the grid comprising an inboard rib pattern adjacent to the grid inboard end and an outboard rib pattern adjacent to the grid outboard end, the inboard and outboard rib patterns extending across the width and embedded in the grid so the inboard and outboard rib patterns wrap around respectively the inboard and outboard tensioning shafts when opposing rotating forces are applied to the inboard and outboard tensioning shafts.

18. The printing machine of claim 17, the grid comprising a first solid area adjacent to the inboard rib pattern and a second solid area adjacent to the outboard rib pattern, the first and second solid areas devoid of grid openings.

19. The printing machine of claim 17, the inboard rib pattern comprising thirteen ribs and the outboard rib pattern comprising thirteen ribs.

20. The printing machine of claim 17, the plurality of grid openings comprising a hex pattern.

* * * * *